US008132652B2

(12) United States Patent
Hakala et al.

(10) Patent No.: US 8,132,652 B2
(45) Date of Patent: Mar. 13, 2012

(54) ELEVATOR SYSTEM INCLUDING PLURALITY OF ELEVATORS OPERATING IN SAME HOISTWAY

(75) Inventors: Harri Hakala, Hyvinkää (FI); Marja-Liisa Siikonen, Helsinki (FI); Janne Sorsa, Helsinki (FI); Henri Hakonen, Espoo (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 13/067,078

(22) Filed: May 6, 2011

(65) Prior Publication Data

US 2011/0209950 A1 Sep. 1, 2011

Related U.S. Application Data

(63) Continuation of application No. PCT/FI2009/000099, filed on Nov. 27, 2009.

(30) Foreign Application Priority Data

Nov. 28, 2008 (FI) ..... 20080640

(51) Int. Cl.
*B66B 9/00* (2006.01)

(52) U.S. Cl. ..... 187/249; 187/382

(58) Field of Classification Search ..... 187/247, 187/249, 380–389, 391–393
See application file for complete search history.

(56) References Cited

U.S. PATENT DOCUMENTS

| | | | | |
|---|---|---|---|---|
| 5,419,414 | A | 5/1995 | Sakita | |
| 5,663,538 | A * | 9/1997 | Sakita | 187/382 |
| 5,877,462 | A * | 3/1999 | Chenais | 187/249 |
| 6,293,368 | B1 * | 9/2001 | Ylinen et al. | 187/382 |
| 6,364,065 | B1 | 4/2002 | Hikita | |
| 6,871,727 | B2 | 3/2005 | Jokela et al. | |
| 7,140,472 | B2 * | 11/2006 | Tyni et al. | 187/382 |
| 7,198,136 | B2 * | 4/2007 | Urata | 187/383 |
| 7,360,629 | B2 * | 4/2008 | Hagi et al. | 187/249 |
| 7,487,860 | B2 * | 2/2009 | Hikita et al. | 187/249 |
| 7,546,906 | B2 * | 6/2009 | Tyni et al. | 187/382 |
| 7,841,450 | B2 * | 11/2010 | Smith et al. | 187/249 |
| 2005/0189181 | A1 | 9/2005 | Meyle et al. | |
| 2007/0151810 | A1 | 7/2007 | Aulanko et al. | |
| 2008/0142312 | A1 | 6/2008 | Terry et al. | |

FOREIGN PATENT DOCUMENTS

| | | |
|---|---|---|
| EP | 1544150 | 6/2005 |
| WO | WO-2004071923 | 8/2004 |
| WO | WO-2006088456 | 8/2006 |

* cited by examiner

*Primary Examiner* — Anthony Salata

(74) *Attorney, Agent, or Firm* — Harness, Dickey & Pierce, P.L.C.

(57) ABSTRACT

An elevator system includes at least one shuttle elevator and at least two local elevators, the elevator cars of which are arranged to travel in the same elevator hoistway such that they can serve at least one shared transfer floor of a transfer level. The control system of the elevator system receives destination calls given from a destination call appliance, forms a plurality of route alternatives and allocates a destination call to one or more elevators by selecting the best route alternative. When allocating a destination call, the control system takes into account that the elevator cars of the local elevators that travel in the same elevator hoistway cannot simultaneously be at a shared transfer floor in cases in which the route alternative includes a part-trip with a local elevator and a change of elevator at a shared transfer floor.

14 Claims, 3 Drawing Sheets

ELEVATOR SYSTEM INCLUDING PLURALITY OF ELEVATORS OPERATING IN SAME HOISTWAY

CROSS-REFERENCE TO RELATED APPLICATIONS

Figure 1:
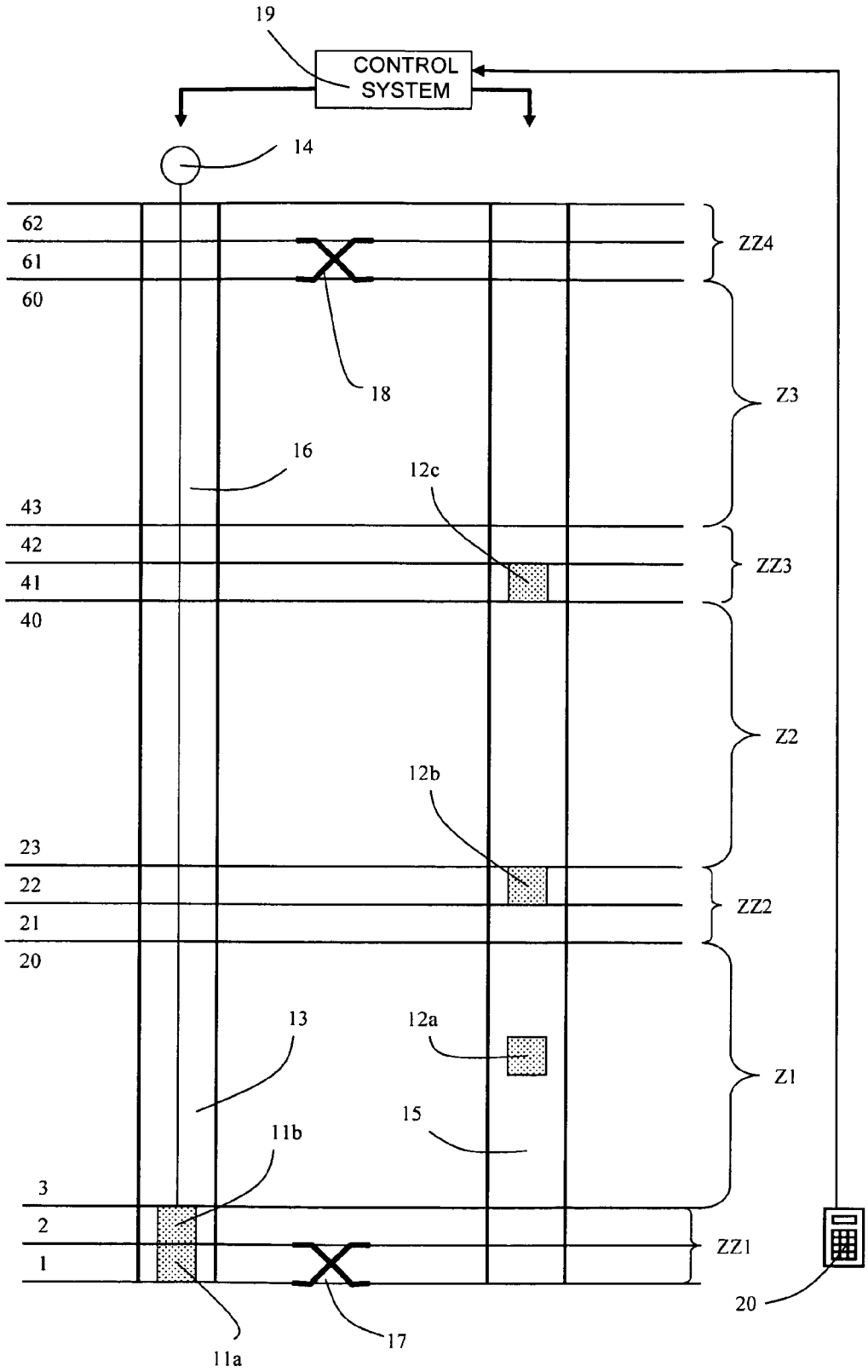

This application is a continuation of PCT/FI2009/000099 filed on Nov. 27, 2009, which is an international application claiming priority from FI 20080640 filed on Nov. 28, 2008, the entire contents of which are hereby incorporated by reference.

FIELD OF THE INVENTION

The invention relates to elevator systems. More particularly the invention relates to elevator systems, in which a number of elevators operate in the same hoistway.

BACKGROUND OF THE INVENTION

In very tall buildings it is not generally possible to profitably construct elevator hoistways that extend from the base floor up to the top floors of the building, the elevators operating in which hoistways would serve all the floors of a building. For this reason the floors of high-rise buildings are conventionally divided into floor zones, which are served with their own local elevators. To arrange the traffic between the zones, some of the floors function as so-called transfer levels (transfer floors), between which shuttle elevators operate taking passengers from the entrance lobby of the building to transfer floors and vice versa. When arriving at a transfer floor according to the route, a passenger takes a local elevator for traveling to the final destination floor. Prior-art solutions, in which local elevators move in their own elevator hoistways, are disadvantageous from the viewpoint of space usage, however, because the number of elevator hoistways needed becomes large. One known method to improve space usage is to dispose a number of elevator cars in the same elevator hoistway. U.S. Pat. No. 5,419,414, among others, discloses an elevator system in which three elevator cars are installed into the same elevator hoistway such that each elevator car is controlled by means of elevator machines disposed in a machine room at the top end of the elevator hoistway. Elevator ropes pass in an overlapping manner from the elevator machines to the elevator cars such that the elevator ropes going to the lowermost elevator car pass two other elevator cars and the elevator ropes going to the middle elevator car pass the topmost car. Corresponding overlapping must be made for the roping of the counterweights of the elevator cars. The cars can drive in the same elevator hoistway in relation to each other according to, among others, the following principles:

- each elevator car moves in its own part of the elevator hoistway, i.e. in a zone, and they do not thus go into the hoistway area of another elevator,
- all the elevator cars can serve all the floors but only one elevator car moves at a time,
- the elevator cars can move at the same time but only in the same direction,
- the elevator cars can move in different directions so long as passenger safety is guaranteed, e.g. the two lowermost cars can move downwards and the topmost car upwards.

U.S. Pat. No. 6,871,727 discloses an elevator system, in which two-car elevators are used as shuttle elevators, which operate between transfer levels. The local elevators operating in different zones are arranged in the same elevator hoistway such that a passenger can transfer from a lower transfer floor of a transfer level to local elevators with which the passenger can get to floors lower than the transfer level, while from an upper transfer floor of a transfer level a passenger can get to local elevators that run to floors higher than the transfer level. By disposing local elevators in the same elevator hoistway, the number of elevator hoistways can be considerably decreased and thus also the space needed for elevator hoistways is also reduced. In the solutions presented, a top clearance is arranged for the local elevators, in which the elevator machine of each local elevator is disposed and that being the case the local elevators cannot serve shared floors such as e.g. the floors of a transfer level. The solution in question easily results in underutilization of the transport capacity of the local elevators and also hampers the transfer of passengers from the shuttle elevators to local elevators serving onward connections. Escalators between the transfer floors are also needed for the transfer levels, taking up extra space and making the overall solution expensive and complex.

PURPOSE OF THE INVENTION

The purpose of the present invention is to eliminate or at least to alleviate the aforementioned drawbacks that occur in prior-art solutions. The purpose of the invention is also to achieve one or more of the following objectives:

- to improve efficiency in the usage of space in high-rise buildings,
- to improve efficiency in the transport capability of an elevator system,
- to facilitate and speed up travel,
- to improve passenger safety,
- a simple and cost-effective elevator system,
- an elevator system that is suited to very tall buildings,
- to reduce the need for escalators or other such transport systems at transfer levels,
- a solution in which elevator hoistways can function as support structures of a building,
- an elevator system in which the allocation of calls can be performed more optimally than before.

SUMMARY OF THE INVENTION

The elevator system according to the invention is characterized by what is disclosed in the characterization part of claim 1. The method of the invention is characterized by what is disclosed in the characterizing part of claim 10. Some inventive embodiments are also presented in the descriptive section and in the drawings of the present application. The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts. The features of the various embodiments can be applied within the framework of the basic inventive concept in conjunction with other embodiments.

The present invention discloses a method for allocating destination calls in an elevator system, which elevator system comprises at least one shuttle elevator, which serves at least one transfer floor of a transfer level, at least two local elevators, the elevator cars of which are arranged to travel in the same elevator hoistway such that they can both serve at least one aforementioned transfer floor. In the method a destination call given by a passenger is received, a plurality of route alternatives according to the destination call is formed from the departure floor to the destination floor, and one or more elevators are allocated to the use of the passenger by selecting the best route alternative on the basis of a given optimization criterion. In the method according to the invention, when allocating a destination call it is taken into account that the elevator cars of the local elevators that travel in the same elevator hoistway cannot simultaneously be at a transfer floor shared by them in cases in which the route alternative comprises a part-trip with a local elevator and a change of elevator at the aforementioned shared transfer floor.

The present invention also discloses an elevator system, which comprises at least one shuttle elevator, which serves at least one transfer floor of a transfer level, at least two local elevators, the elevator cars of which are arranged to travel in the same elevator hoistway such that they can both serve at least one aforementioned transfer floor, at least one destination call appliance, a control system that controls the elevator system, which control system is arranged to receive destination calls given from a destination call appliance, to form a plurality of route alternatives according to the destination call from the departure floor to the destination floor and to allocate one or more elevators for the use of the passenger by selecting the best route alternative on the basis of a given optimization criterion. According to the invention, when allocating a destination call the control system takes into account that the elevator cars of the local elevators that travel in the same elevator hoistway cannot simultaneously be at a transfer floor shared by them in cases in which the route alternative comprises a part-trip with a local elevator and a change of elevator at the aforementioned shared transfer floor.

In one embodiment of the invention the moment of arrival of the elevator car of a local elevator belonging to the route alternative at the aforementioned shared transfer floor is estimated. The route alternative is removed from the plurality of route alternatives if a second local elevator that travels in the same elevator hoistway will be at the shared transfer floor at the estimated arrival time on the basis of the calls already allocated to the aforementioned second local elevator. Alternatively, an automatic run can be performed to move an elevator car of a local elevator away from a shared transfer floor that belongs to a selected route alternative, if the elevator car in question is empty. An automatic run means in this context that the control system automatically generates a call to some suitable floor, as a consequence of which the elevator car moves away from the shared transfer floor.

In one embodiment of the invention a multicar elevator is used as a shuttle elevator and route alternatives are formed, from which at least one route alternative comprises a part-trip in one elevator car of the shuttle elevator and at least one second route alternative comprises a part-trip in one second elevator car of the shuttle elevator.

In one embodiment of the invention the elevator machine of at last one local elevator is disposed in the elevator hoistway to the side of the path of movement the elevator car of at least one second local elevator, such that the elevator cars can serve at least one shared transfer floor.

In one embodiment of the invention the roping of the elevator car of at least one local elevator is fitted to pass from below the elevator car and the roping of the elevator car of at least one other local elevator is fitted to pass from above the elevator car.

In one embodiment of the invention the suspension ratio of the counterweight of at least one local elevator is greater than the suspension ratio of the elevator car.

In one embodiment of the invention the local elevators are elevators without counterweight.

In one embodiment of the invention one or more local elevators are arranged to operate as a shuttle elevator between transfer levels on the basis of the traffic situation of the elevator system.

With the solution according to the invention numerous advantages are achieved compared to prior-art solutions. With the solution according to the invention, it is possible:

- to minimize the space usage of an elevator system, because the elevators can be elevators without machine room, which do not necessarily need free top clearance/bottom clearance from the elevator hoistway,
- to implement elevator systems of very tall buildings because local elevators operate in a restricted area of movement (floor zone), in which case the ropings of them do not become overlong and the ropings do not need to overlap to pass by other ropings or elevator cars,
- to use elevator components of elevators without machine room, which components are in themselves prior art, in which case the elevators can be implemented cost-effectively and they will be operationally reliable,
- to select the floor-to-floor heights of transfer levels to be essentially the same as the other floor-to-floor heights, in which case multicar elevators will be simplified because the car distances of a multicar elevator do not need to be adjusted or the adjustment need is small compared to corresponding prior-art solutions;
- to facilitate and speed up the transfer of passengers from shuttle elevators to local elevators and vice versa because passengers do not need to transfer from one floor to another at a transfer level but instead a local elevator according to the onward connection can collect a passenger from any floor whatsoever of a transfer level. That being the case, the need to arrange escalators between transfer floors also decreases;
- to better optimize the transport capacity of an elevator system, energy consumption, the waiting times of passengers and/or other performance factors of the elevator system because there are essentially more possible route alternatives for allocating calls than in prior-art solutions,
- to improve the transport capacity of an elevator system because some of the local elevators can also function as shuttle elevators, depending on the traffic situation of the elevator system, such as e.g. during upward traffic congestion;
- to improve passenger safety, because the number of floors to be jointly served by the elevators is small.

LIST OF FIGURES

In the following, the invention will be described in detail by the aid of a few examples of its embodiments, wherein:

FIG. 1 presents an elevator system according to the invention

Figure 2:
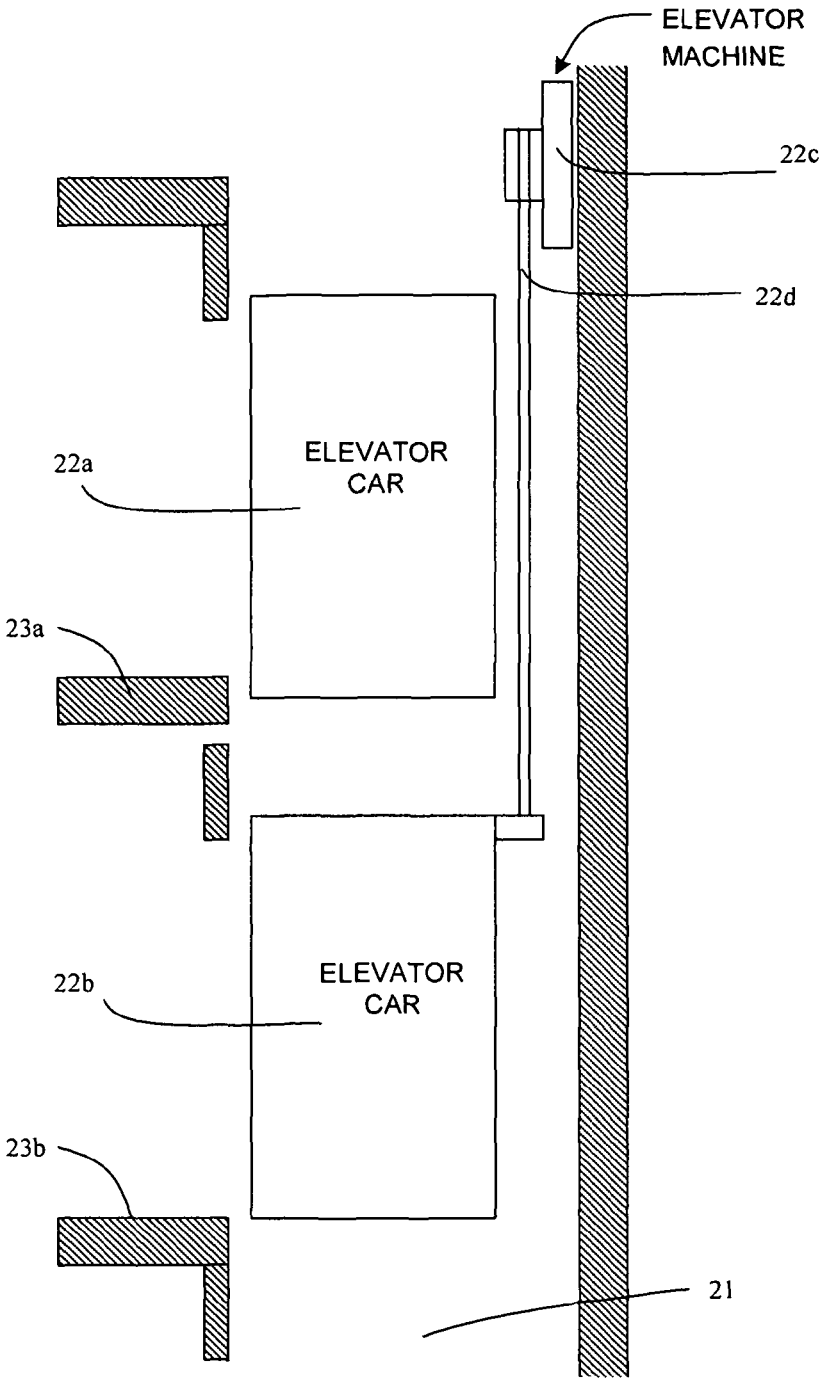
Figure 3A:
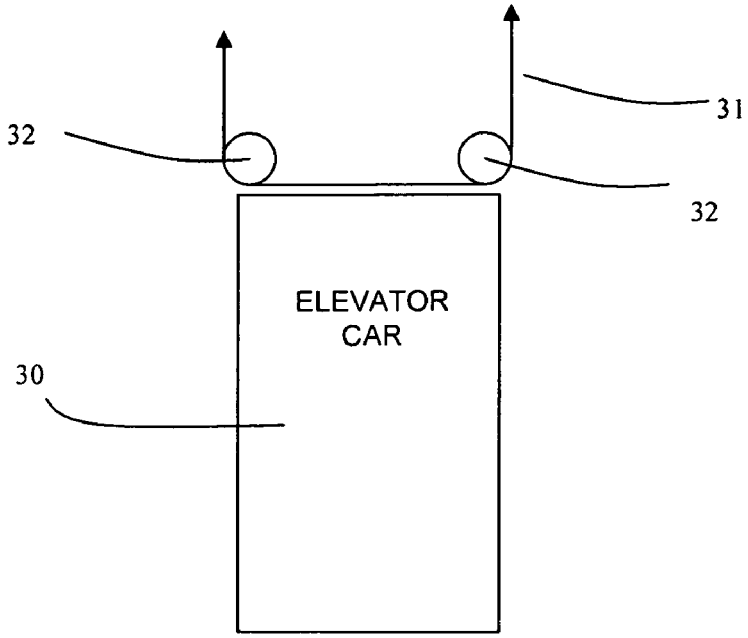
Figure 3B:
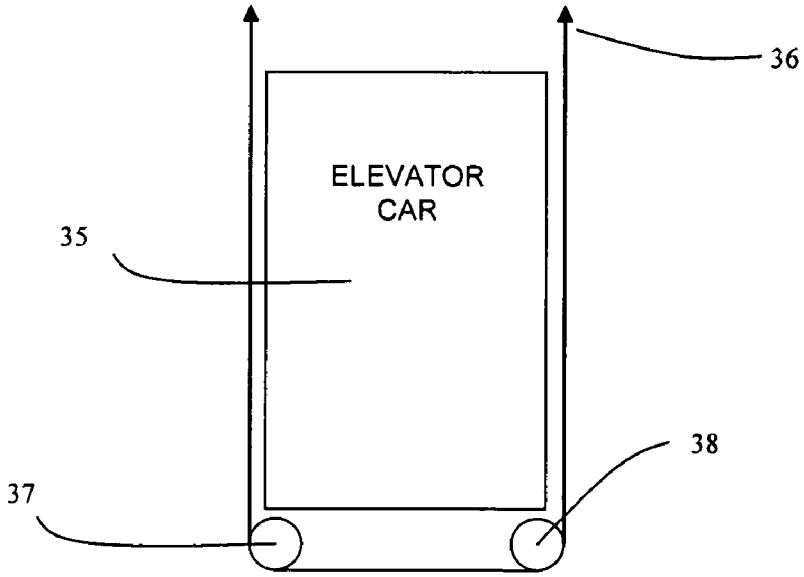

FIG. 2 presents the placement of the drive machinery in the elevator hoistway, and FIGS. 3*a* and 3*b* present the suspension above and below the elevator car.

DETAILED DESCRIPTION OF THE INVENTION

FIG. 1 presents an elevator system according to the invention, which comprises one two-car elevator 11 with elevator cars 11*a*, 11*b*, as well as a plurality of local elevators 12, of which for the sake of simplicity only the elevator cars 12*a*,

12*b* and 12*c* are drawn in the figure, which elevator cars operate in the elevator hoistway 15. The building is divided into three local zones such that floors 3-20 form zone Z1, floors 23-40 form zone Z2, and floors 43-60 form zone Z3. Between the zones are transfer levels such that the transfer level ZZ1 comprises floors 1 and 2, transfer level ZZ2 floors 21 and 22, transfer level ZZ3 floors 41 and 42, and transfer level ZZ4 floors 61 and 62. A shuttle elevator 11 mainly handles traffic between the transfer levels, while local elevators 12 handle the local traffic between the aforementioned transfer levels and aforementioned zones as well as the internal traffic of the zones. In addition, the travelators 17 and 18 between the floors of the transfer level, i.e. between the transfer floors, are marked on the transfer levels ZZ1 and ZZ4 of FIG. 1.

The two-car elevator 11 is a shuttle elevator, which moves in the elevator hoistway 13 by means of an elevator machine 14 serving all the floors of a building. The elevator system is controlled with a control system 19, which receives calls given by passengers on the floors and allocates, according to the call, one or more elevator cars for the use of the passengers. Control system in this context means generally all the interface units and control units needed by the elevator system for controlling the elevators on the basis of the calls given.

The local elevators 12 are arranged in the same elevator hoistway 15 according to FIG. 1. Each local elevator serves at least one zone as well as the transfer levels connected to a zone, i.e. the consecutive local elevators in the same elevator hoistway have as shared floors the floors of a transfer level separating the zones. That being the case, the local elevator 12*a* serves floors 1-22, the local elevator 12*b* serves floors 21-43, and the local elevator 12*c* floors 41-62. So that the movement lengths of the local elevators could overlap in the operating areas of each other, the elevator machines of local elevators are disposed in the elevator hoistway to the side of the paths of movement of the elevator cars such that they do not limit access of the elevator cars to the floor levels to be jointly served. To guarantee passenger safety, the elevator cars are provided with safety means (not presented in FIG. 1), with which it is detected whether a second elevator car moving in the same elevator hoistway will come to a smaller distance than a certain safety distance, in which case the safety means forcibly stop both elevator cars to prevent a collision. To improve passenger safety the elevator cars of the local elevators approach the shared floor levels at a suitable creeping speed, which is essentially smaller with respect to the normal speed of the elevator cars. Owing to creeping speed the stopping distance of the elevator cars can be made to be short, if a collision hazard is detected.

The elevator system according to FIG. 1 comprises call giving appliances on each floor level, which at least on the transfer level are preferably destination call appliances 20, by means of which passengers can indicate their destination floor while still on the departure floor. According to prior art, a terminal device in the possession of a passenger, e.g. a mobile phone, can also function as a call giving appliance, by using which a passenger can indicate his/her destination floor to the elevator system. A call given by a passenger from a call giving appliance is transmitted to the control system 19 of the elevator system, which control system allocates one or more elevator cars for the use of the passenger for traveling to the destination floor. The allocation of calls can be based on allocation methods that are, in themselves, prior art, such as e.g. genetic or other corresponding algorithms, in which one or more performance factors, such as e.g. the waiting time of a passenger, total travel time, energy consumption related to the service of a call, et cetera, can be optimized. The performance factors to be optimized form the so-called optimization criteria. In the elevator system according to FIG. 1 the route alternatives connected to a call are essentially more than in elevator systems according to prior art. For example, if in the elevator system according to FIG. 1 a passenger gives in the entrance lobby (on floor 1) a destination call to floor 38, the possible route alternatives are in this case, depending on the status of the elevator at that time, the following route alternatives, among others:

- travel in the upper car 11*b* of the shuttle elevator 11 to floor 22, from where an onward trip with the elevator 12*b* to floor 38,
- travel in the lower car 11*a* of the shuttle elevator 11 to floor 21, from where an onward trip with the elevator 12*b* to floor 38,
- travel in the upper car 11*b* of the shuttle elevator 11 to floor 41, from where an onward trip with the elevator 12*b* to floor 38,
- travel in the lower car 11*a* of the shuttle elevator 11 to floor 41, from where an onward trip with the elevator 12*b* to floor 38,
- travel with the elevator 12*a* to floor 21, from where an onward trip with the elevator 12*b* to floor 38,
- travel with the elevator 12*a* to floor 22, from where an onward trip with the elevator 12*b* to floor 38, In practice the local elevators are in more than one elevator hoistway, in which case also the number of route alternatives is considerably greater than what is presented by way of example above. The large number of route alternatives enables efficient optimization when allocating elevator cars for the use of passengers. Allocation according to the above example can be performed either in one phase, in which case the elevator cars serving both the first part-trip and the second part-trip are decided immediately, or in two phases, in which case the elevator car serving the second part-trip is decided when the elevator car performing the first part-trip has arrived, or is arriving, at the planned transfer floor. The elevator serving the onward route is indicated in this case with signs on the transfer level and/or by sending the relevant information directly to a terminal device in the possession of the passenger. In the allocation it must, of course, be taken into account that the elevator cars moving in the same elevator hoistway cannot be at a shared transfer floor at the same time. In this case the control system can estimate the arrival time of the local elevator belonging to the route alternative and remove the route alternative from the plurality of route alternatives if an elevator car of a second local elevator that travels in the same elevator hoistway will be at the shared transfer floor in question at the estimated arrival time on the basis of the calls already allocated to the second local elevator in question. The control system can also perform an automatic run to move an elevator car of a local elevator away from a transfer floor, if the elevator car in question is empty and prevents the arrival of an elevator car of a local elevator that belongs to the route alternative from arriving at the transfer floor.

The elevator system according to the invention also enables the use of local elevators in the manner of shuttle elevators. The elevator system comprises in this case preferably a number of elevator hoistways, e.g. eight elevator hoistways, in which local elevators move in the same elevator hoistways in the manner of FIG. 1. If the control system of the elevator system detects e.g. upward congestion, the control system reserves e.g. the local elevator 12*a* for shuttle elevator use, in which the local elevator in question operates between transfer levels ZZ1 and ZZ2 but the other local elevators of the zone Z1 serve the floors of the zone Z1.

FIG. 2 presents by way of examples how the machinery can be disposed in the elevator hoistway according to the invention. The elevator cars 22*a* and 22*b* serve the shared floor levels 23*a* and 23*b* in the elevator hoistway 21. The elevator car 22*b* is moved by means of the hoisting roping 22*d* and the drive machinery 22*c*. The elevator machine 22*c* that moves the elevator car 22*b* is disposed on the wall 21*a* of the elevator hoistway 21 to the side of the path of movement of the elevator car 22*a* such that the elevator car 22*a* can reach the floor levels 23*a* and 23*b* when the elevator car 22*b* does not obstruct it. For the sake of clarity, the drive machinery of the elevator car 22*a* and the corresponding roping are not shown in FIG. 2. The elevators can be either elevators without counterweight or elevators with counterweight. If the elevators are elevators with counterweight, the movement distance of the counterweights can be reduced by selecting a suspension ratio of the counterweight that is greater than the suspension ratio of the elevator cars.

FIGS. 3*a* and 3*b* present by way of example the suspension above and below the elevator car. The roping 31 of the elevator car 30 is fitted to pass from the top of the elevator car 30 via the diverting pulleys 32 fixed to the elevator car. Correspondingly, the roping 36 of the elevator car 35 is fitted to pass from below the elevator car 35 via the diverting pulleys 37 fixed to the elevator car. With the roping according to FIGS. 3*a* and 3*b*, a suspension ratio of the elevator car of 2:1 is obtained. With the arrangement the minimum distance of the elevator cars can be made to be very small.

The invention is not limited solely to the embodiments described above, but instead many variations are possible within the scope of the inventive concept defined by the claims below. Thus, for example, a multicar elevator can comprise three or even more elevator cars instead of two elevator cars. Also there can be a number of shuttle elevators, which operate in the same elevator hoistway and/or in different elevator hoistways, in the elevator system.

The invention claimed is:

1. An elevator system, comprising:
   - at least one shuttle elevator, which serves at least one transfer level, which transfer level comprises at least one transfer floor;
   - at least two local elevators, elevator cars of which are arranged to travel in a same elevator hoistway such that the aforementioned elevator cars can serve at least one shared transfer floor of the aforementioned transfer level;
   - at least one destination call appliance;
   - a control system, which is arranged to receive destination calls given from the destination call appliance, to form a plurality of route alternatives according to the destination call from a departure floor to a destination floor, and to allocate the destination call to one or more elevators by selecting a best route alternative on the basis of a given optimization criterion, wherein when allocating the destination call the control system is arranged to take into account that the elevator cars of the local elevators that travel in a same elevator hoistway cannot simultaneously be at an aforementioned shared transfer floor in cases in which the route alternative comprises a part-trip with a local elevator and a change of elevator at the aforementioned shared transfer floor.

2. The elevator system according to claim 1, wherein the control system is arranged to estimate an arrival time of a local elevator belonging to the route alternative at the aforementioned shared transfer floor and to remove the route alternative from the plurality of route alternatives if an elevator car of a second local elevator that travels in the same elevator hoistway will be at the aforementioned shared transfer floor at the estimated arrival time on the basis of the calls already allocated to the aforementioned second local elevator.

3. The elevator system according to claim 1, wherein the control system is arranged to perform an automatic run to move an elevator car of a local elevator away from a shared transfer floor that belongs to a selected route alternative, if the elevator car in question is empty.

4. The elevator system according to claim 1, wherein an elevator machine of at last one aforementioned local elevator is disposed in the elevator hoistway to the side of the path of movement of at least one elevator car of the aforementioned local elevator such that the aforementioned elevator cars can serve the aforementioned at least one shared transfer floor.

5. The elevator system according to claim 1, wherein a roping of the elevator car of at least one local elevator is fitted to pass from below the elevator car, and a roping of the elevator car of at least one other local elevator is fitted to pass from above the elevator car.

6. The elevator system according to claim 1, wherein the shuttle elevator is a multicar elevator.

7. The elevator system according to claim 1, wherein at least one local elevator is an elevator with counterweight, wherein a suspension ratio of the counterweight is greater than a suspension ratio of the elevator car.

8. The elevator system according to claim 1, wherein at least one local elevator is an elevator without counterweight.

9. The elevator system according to claim 1, wherein one or more local elevators are arranged to operate as a shuttle elevator between two transfer levels on the basis of the traffic situation determined by the control system.

10. A method for allocating destination calls in an elevator system, the elevator system including,
   - at least one shuttle elevator, which serves at least one transfer level, which transfer level comprises at least one transfer floor,
   - at least two local elevators, elevator cars of which are arranged to travel in a same elevator hoistway such that the aforementioned elevator cars can serve at least one shared transfer floor of the aforementioned transfer level, and wherein in the method:
   - a destination call given by a passenger is received;
   - a plurality of route alternatives according to the destination call is formed from a departure floor to a destination floor; and
   - the destination call is allocated to one or more elevators by selecting a best route alternative on the basis of a given optimization criterion, wherein when allocating the destination call it is taken into account that the elevator cars of the local elevators that travel in the same elevator hoistway cannot simultaneously be at a same shared transfer floor in cases in which the route alternative comprises a part-trip with a local elevator and a change of elevator at the aforementioned shared transfer floor.

11. The method according to claim 10, wherein the method comprises the phases:
   - the moment of arrival of an elevator car of a local elevator belonging to the route alternative at the aforementioned shared transfer floor is estimated; and
   - the route alternative is removed from the plurality of route alternatives if a second local elevator that travels in the same elevator hoistway will be at the aforementioned shared transfer floor at the arrival time on the basis of the calls already allocated to the aforementioned second local elevator.

12. The method according to claim 10, wherein an automatic run is performed to move an elevator car of a local elevator away from a shared transfer floor that belongs to a selected route alternative, if the aforementioned elevator car is empty.

13. The method according to claim 10, in which method a multicar elevator is used as a shuttle elevator, wherein route alternatives are formed, of which at least one route alternative comprises a part-trip in one elevator car of the shuttle elevator and at least one second route alternative comprises a part-trip in one second elevator car of the shuttle elevator.

14. The method according to claim 10, wherein one or more local elevators are used as a shuttle elevator between two transfer levels on the basis of the traffic situation prevailing in the elevator system.

* * * * *